US006161487A

United States Patent [19]

Chang

[11] Patent Number: 6,161,487

[45] Date of Patent: Dec. 19, 2000

[54] COMPUTER OFFICE TABLE STRUCTURE

[76] Inventor: Chien-Kuo Chang, Fl. 10-2, No. 447, Sec. 3, Wen-Hsin Rd., Taichung, Taiwan

[21] Appl. No.: 09/351,179

[22] Filed: Jul. 12, 1999

[51] Int. Cl.[7] ..... A47B 37/00

[52] U.S. Cl. ..... 108/50.01; 108/64; 312/195; 248/159

[58] Field of Search ..... 108/50.01, 50.02, 108/64, 65, 69, 59, 102, 103, 185, 186, 189, 94, 95; 312/223.1, 223.3, 195, 197; 248/917, 918, 159, 128, 129

[56] References Cited

U.S. PATENT DOCUMENTS

| | | | |
|---|---|---|---|
| 3,383,147 | 5/1968 | Proulx et al. | 312/197 |
| 4,679,510 | 7/1987 | Veyhl et al. | 108/64 X |
| 4,852,500 | 8/1989 | Ryburg et al. | 312/195 X |
| 5,605,311 | 2/1997 | McGrath et al. | 108/50.14 X |
| 5,704,298 | 1/1998 | Corpuz, Jr. et al. | 108/50.01 |
| 5,842,425 | 12/1998 | van der Aa | 108/64 |
| 5,868,079 | 2/1999 | Charny | 108/7 |
| 5,967,058 | 10/1999 | Ambrose et al. | 108/64 |
| 5,973,966 | 8/1999 | Machado et al. | 108/64 |

FOREIGN PATENT DOCUMENTS

| | | | |
|---|---|---|---|
| 815775 | 1/1998 | European Pat. Off. . | |
| 1463176 | 12/1966 | France | 108/64 |

*Primary Examiner*—Peter M. Cuomo
*Assistant Examiner*—Hanh V. Tran
*Attorney, Agent, or Firm*—Rosenberg, Klein & Lee

[57] ABSTRACT

A computer office table structure includes an upstanding rod having a lower end fixed to a supporting base and an upper end provided with a shoulder, a supporting post extending upward from the shoulder and having a diameter smaller than that of the upstanding rod, a first table supporting member provided with a plurality of crossbars and including a first end provided with a first extension bar having a first sleeve rotatably mounted on the supporting post, and a second end provided with a first table leg and two first rollers each rotatably mounted on the first table leg, a second table supporting member provided with a plurality of crossbars and including a first end provided with a second extension bar having a second sleeve rotatably mounted on the supporting post and a second end provided with a second table leg and two second rollers each rotatably mounted on the second table leg, two table plates each mounted on the first table supporting member and the second table supporting member, and a supporting disk mounted on the supporting post and having a level flush with that of the two table plates.

11 Claims, 9 Drawing Sheets

COMPUTER OFFICE TABLE STRUCTURE

BACKGROUND OF THE INVENTION

1. Field of the Invention

The present invention relates to a computer office table structure.

2. Description of the Related Prior Art

A conventional office table has a fixed structure and occupies large space such that it cannot be moved easily, thereby greatly limiting the utility and mobility of the office table. In addition, the conventional office table cannot co-operate with a computer equipment such that it is necessary to additionally provide a computer table for supporting the computer equipment, thereby limiting the versatility of the office table.

SUMMARY OF THE INVENTION

The primary objective of the present invention is to provide a computer office table structure comprising: a supporting base; an upstanding rod having a lower end fixed to the supporting base and an upper end provided with a shoulder, a supporting post extending upward from the shoulder and having a diameter smaller than that of the upstanding rod; a first table supporting member pivotally mounted to the upstanding rod and provided with a plurality of crossbars, the first table supporting member including a first end provided with a first extension bar having a first sleeve rotatably mounted on the supporting post, and a second end provided with a first table leg and two first rollers each rotatably mounted on the first table leg; a second table supporting member pivotally mounted to the upstanding rod and provided with a plurality of crossbars, the second table supporting member including a first end provided with a second extension bar having a second sleeve rotatably mounted on the supporting post and a second end provided with a second table leg and two second rollers each rotatably mounted on the second table leg; two table plates each mounted on the first table supporting member and the second table supporting member; and a supporting disk mounted on the supporting post and having a level flush with that of the two table plates.

Further objectives and advantages of the present invention will become apparent after a careful reading of the detailed description with reference to the accompanying drawings.

DETAILED DESCRIPTION OF THE PREFERRED EMBODIMENTS

Figure 1:
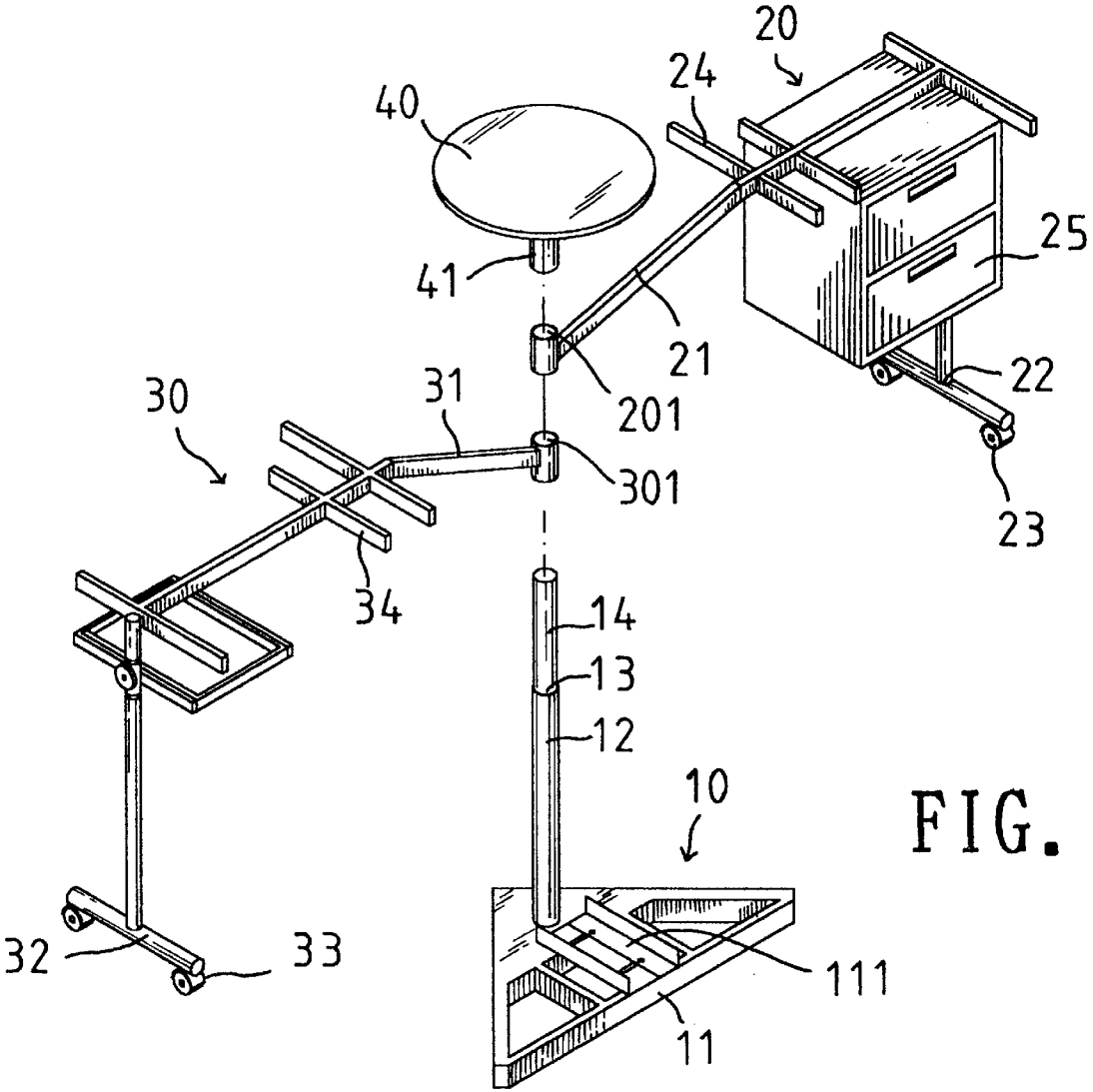
FIG. 1 is an exploded view of a computer office table structure according to the present invention.
Figure 2:
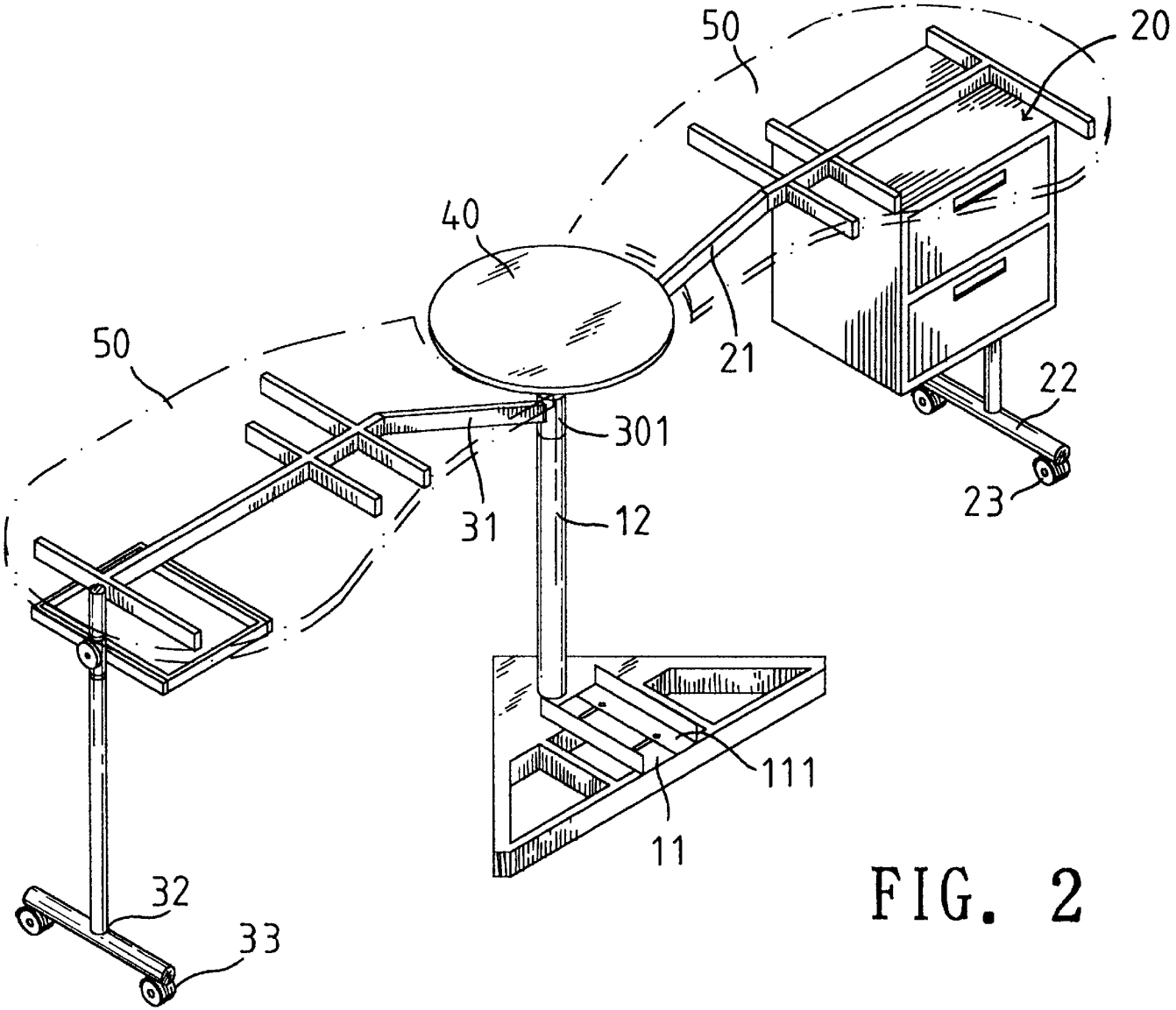
FIG. 2 is a perspective assembly view of the computer office table structure as shown in FIG. 1.

With reference to FIGS. 1–4, a computer office table structure according to the present invention comprises a supporting base 11 defining a receiving portion 111, an upstanding rod 12 having a lower end fixed to the supporting base 11 and an upper end provided with a shoulder 13, a supporting post 14 extending upward from the shoulder 13 and having a diameter smaller than that of the upstanding rod 12, a first table supporting member 30 pivotally mounted to the upstanding rod 12 and provided with a plurality of crossbars 34, the first table supporting member 30 including a first end provided with a first extension bar 31 having a first sleeve 301 rotatably mounted on the supporting post 14, and a second end provide 4 with a first table leg 32 and two first rollers 33 each rotatably mounted on the first table leg 32, a second table supporting member 20 pivotally mounted to the upstanding rod 12 and provided with a plurality of crossbars 24 for positioning a cabinet 25, the second table supporting member 20 including a first end provided with a second extension bar 21 having a second sleeve 201 rotatably mounted on the supporting post 14 and a second end provided with a second table leg 22 and two second rollers 23 each rotatably mounted on the second table leg 22, two table plates 50 each mounted on the first table supporting member 30 and the second table supporting member 20, and a supporting disk 40 mounted on the supporting post 14 and having a level flush with that of the two table plates 50.

The supporting disk 40 includes an insert tube 41 provided on the bottom thereof and mounted on the supporting post 14. The first extension bar 31 of the first table supporting member 30 is inclined relative to the first table supporting member 30, and the second extension bar 21 of the second table supporting member 20 is inclined relative to the second table supporting member 20. The inclination of the first extension bar 31 is different from that of the second extension bar 21 such that the first table supporting member 30 has a level flush with that of the second table supporting member 20 so that the two table plates 50 are flush with each other.

Figure 3:
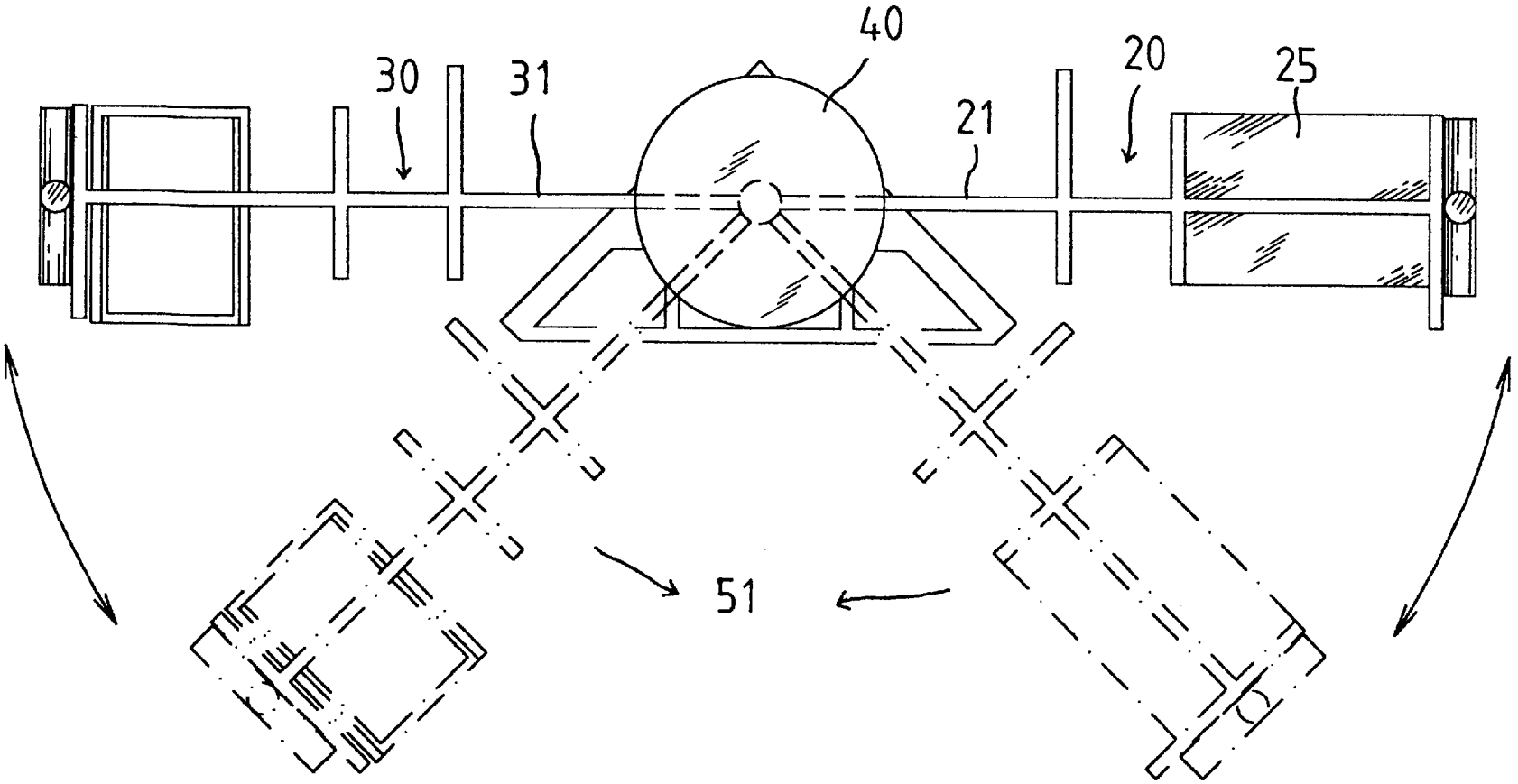
FIG. 3 is a top plan view of the computer office table structure as shown in FIG. 2.
Figure 4:
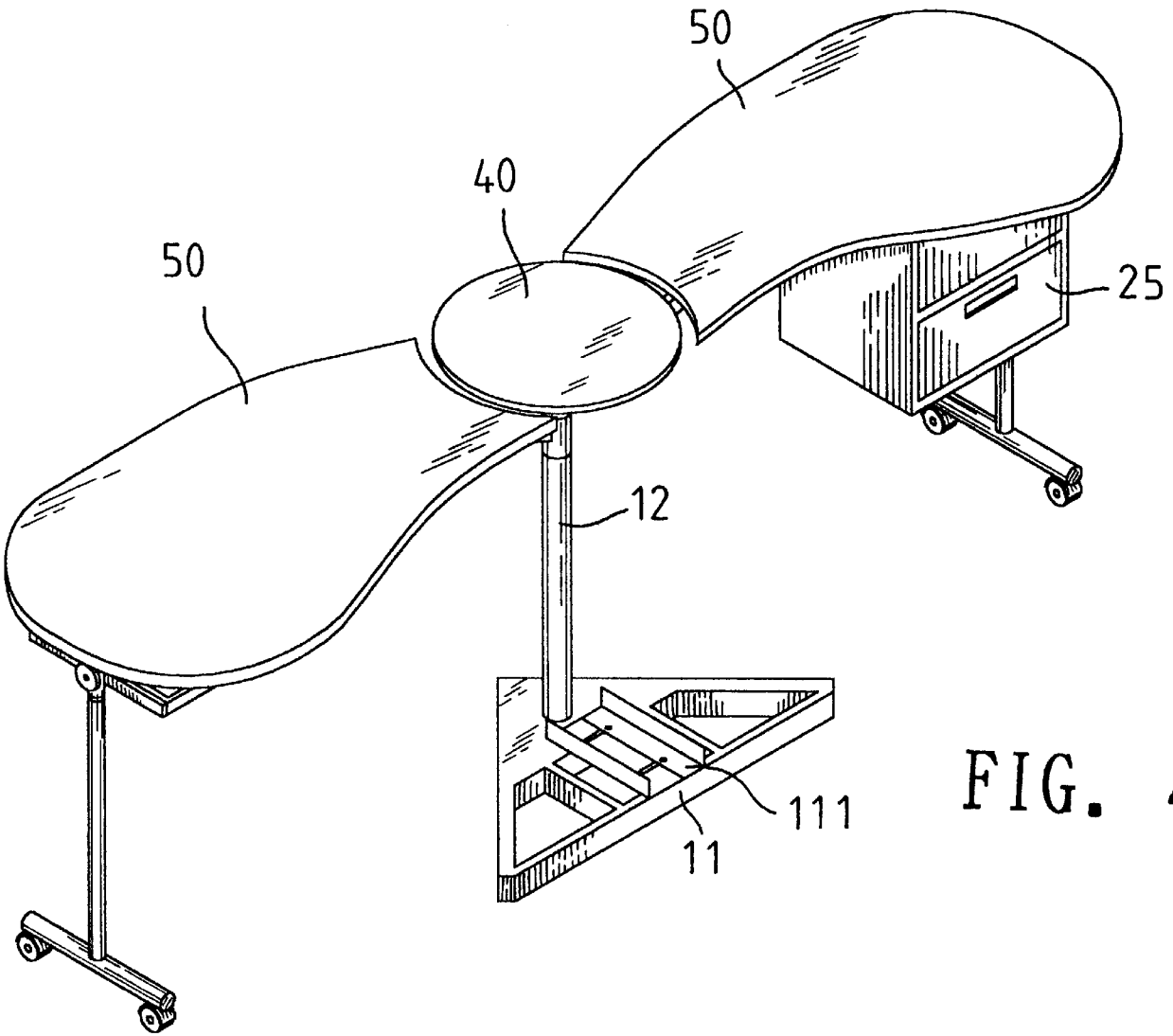
FIG. 4 is a perspective assembly view of the computer office table structure as shown FIG. 1.

As shown in FIG. 3, the first table supporting member 30 and the second table supporting member 20 are respectively pivoted relative to the supporting post 14 such that a user can optionally adjust the position of the two table plates 50 and the incline angle 51 between the two table plates 50.

As shown in FIGS. 5–8, the computer office table structure also comprises a first keyboard supporting bar 61 having a first end provided with a first bushing 63 rotatably mounted on the supporting post 14 and a second end provided with a first keyboard supporting disk 611, a second keyboard supporting bar 60 having a first end provided with a second bushing 62 rotatably mounted on the supporting post 14 and a second end provided with a second keyboard supporting disk 601, and a keyboard supporting seat 64 mounted on the first keyboard supporting disk 611 and the second keyboard supporting disk 601. The supporting disk 40 defines a hole 42 therein, and the computer office table structure further comprises a second supporting disk 70 provided with an insert tube 71 on the bottom thereof and received in the hole 42 of the supporting disk 40.

Figure 5:
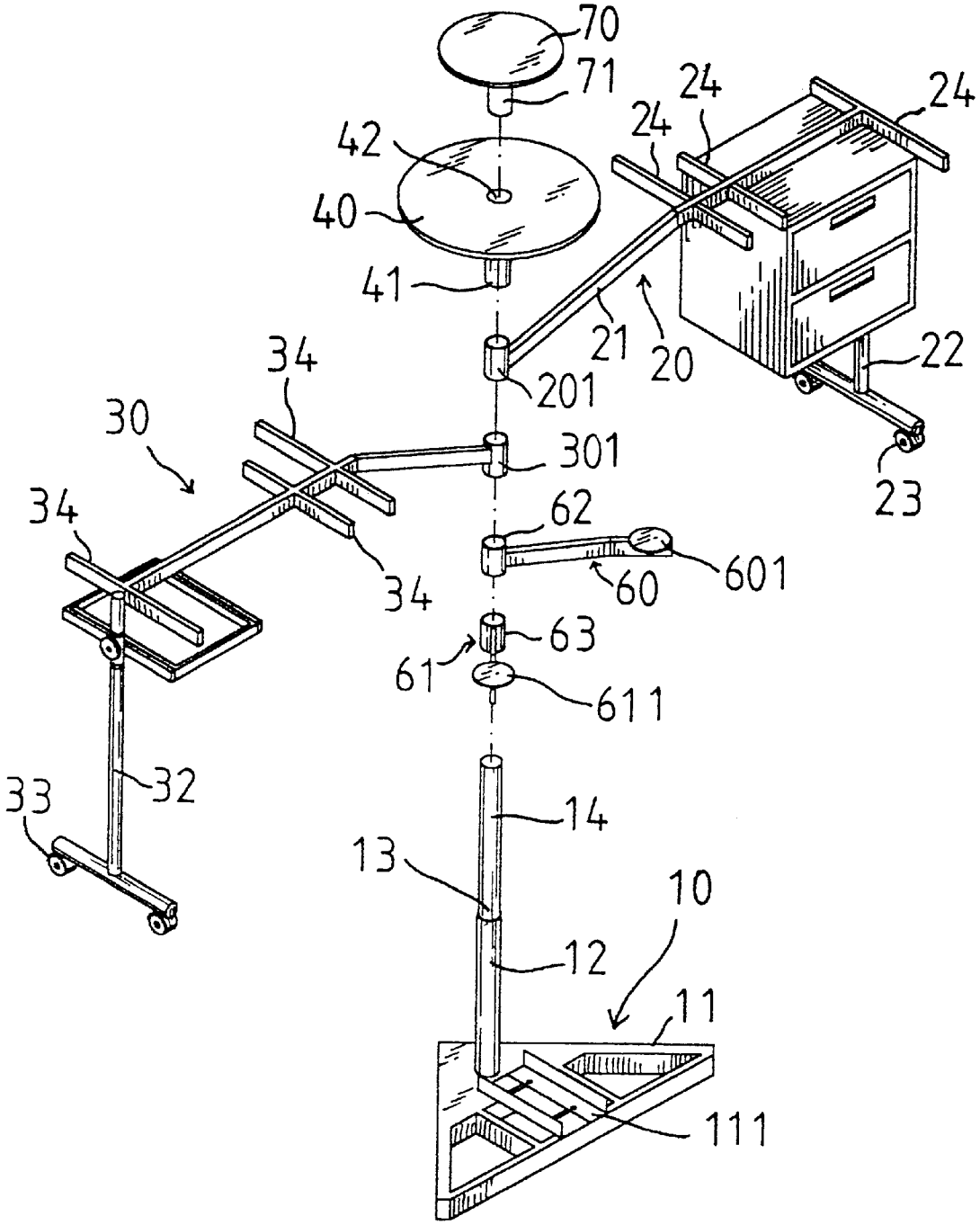
FIG. 5 is an exploded view of a computer office table structure according to an alternative embodiment of the present invention.
Figure 6:
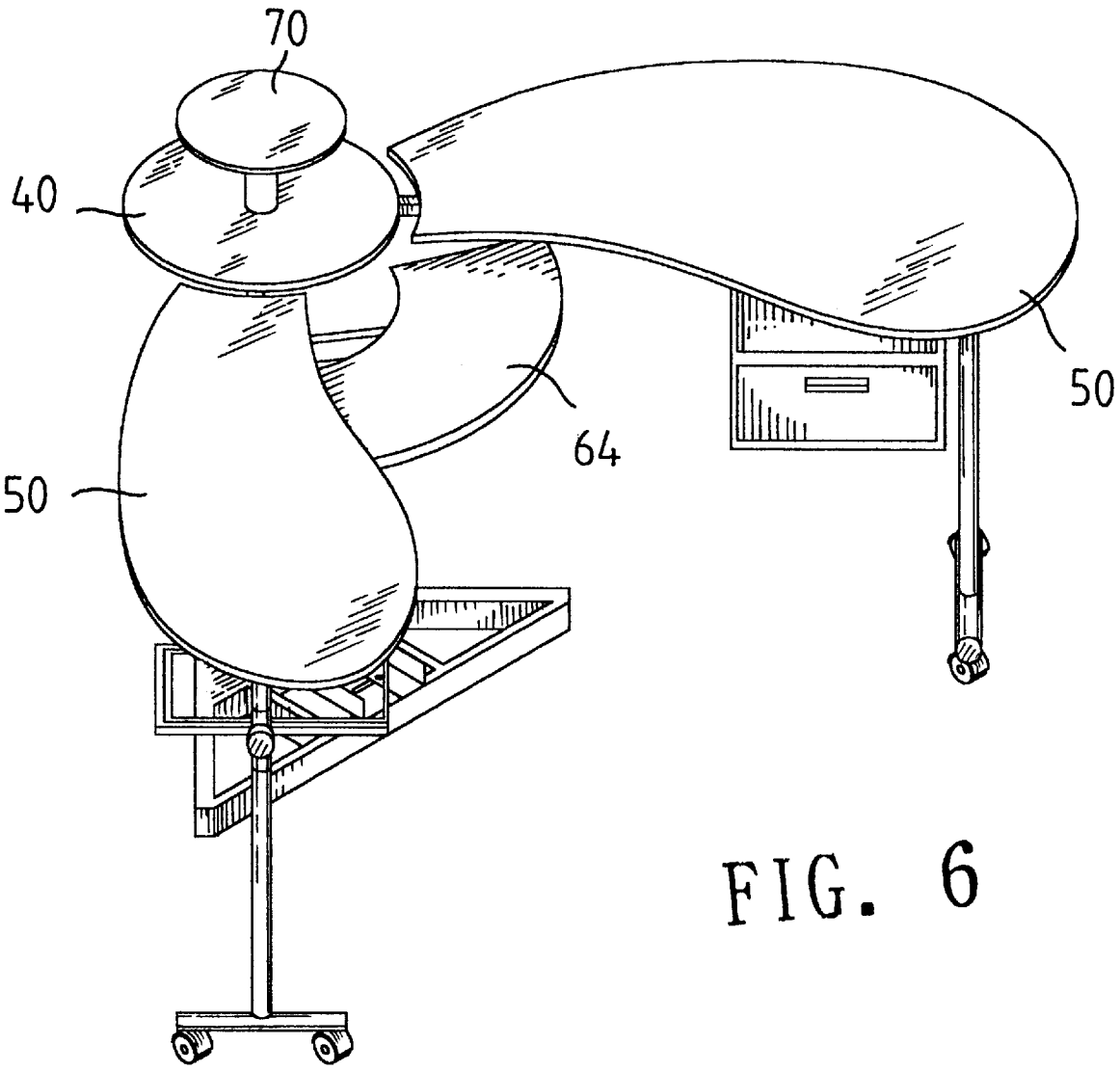
FIG. 6 is a perspective assembly view of the computer office table structure as shown FIG. 5.
Figure 7:
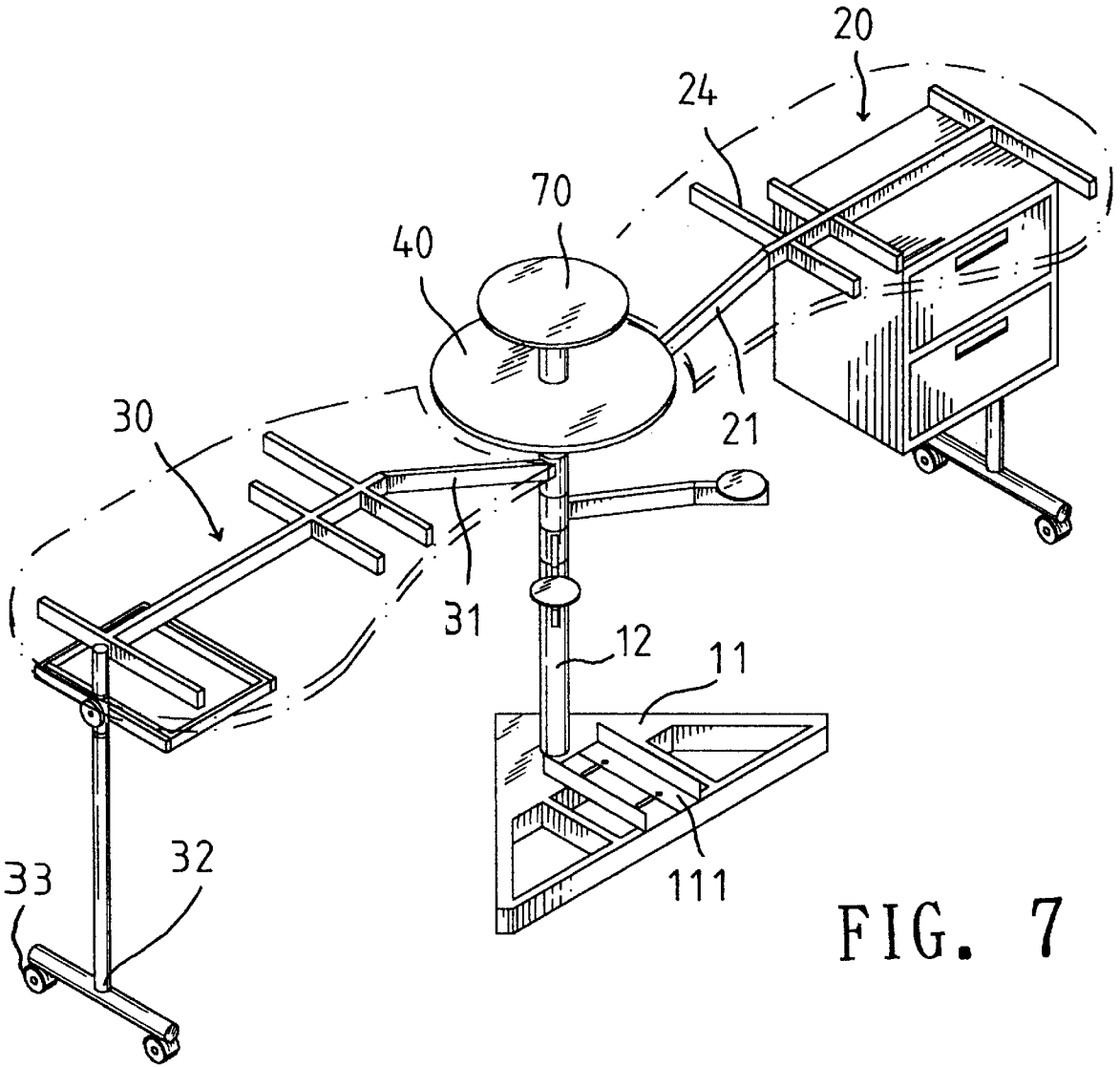
FIG. 7 is a perspective assembly view of the computer office table structure as shown FIG. 5.
Figure 8:
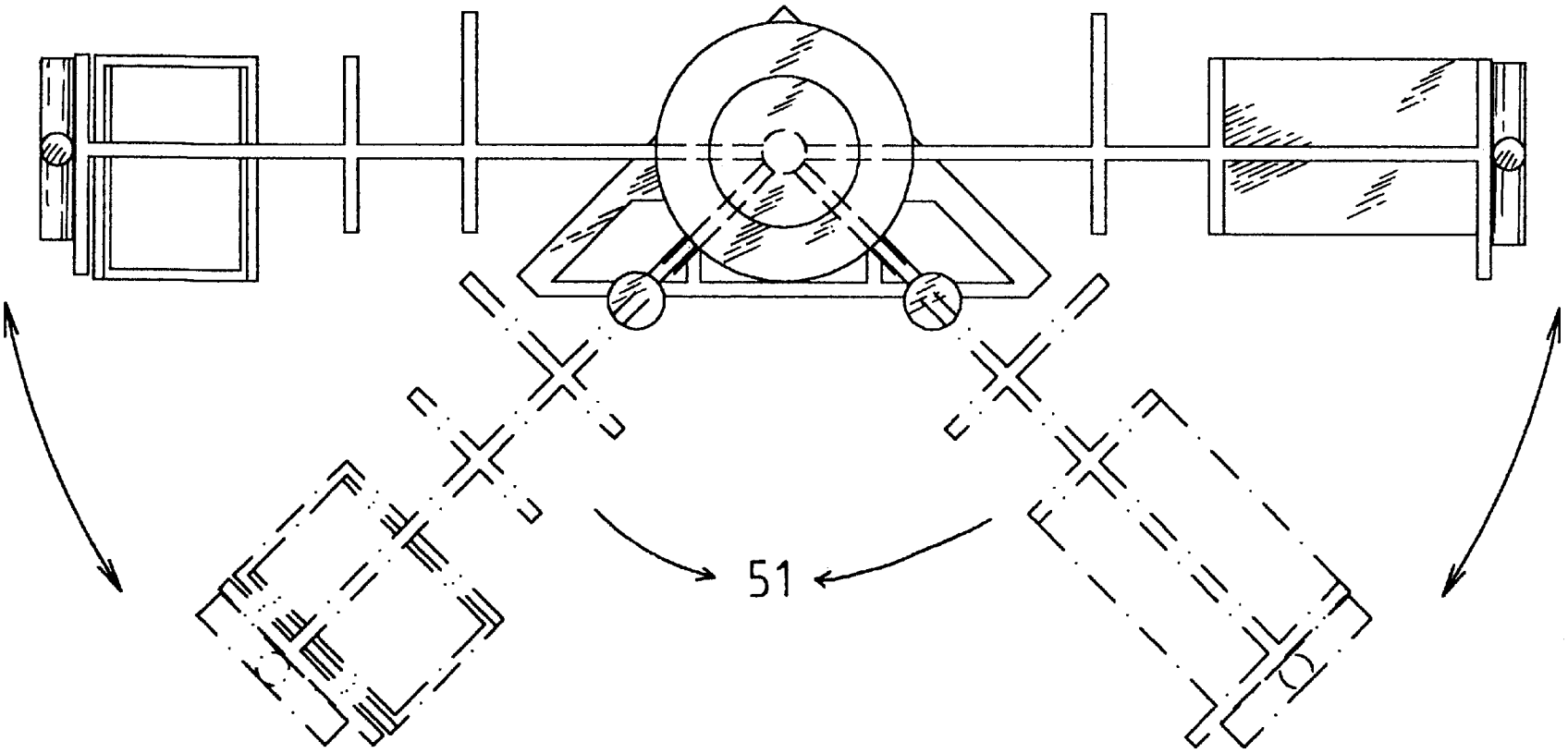
FIG. 8 is a top plan view of the computer office table structure as shown in FIG. 7.
Figure 9:
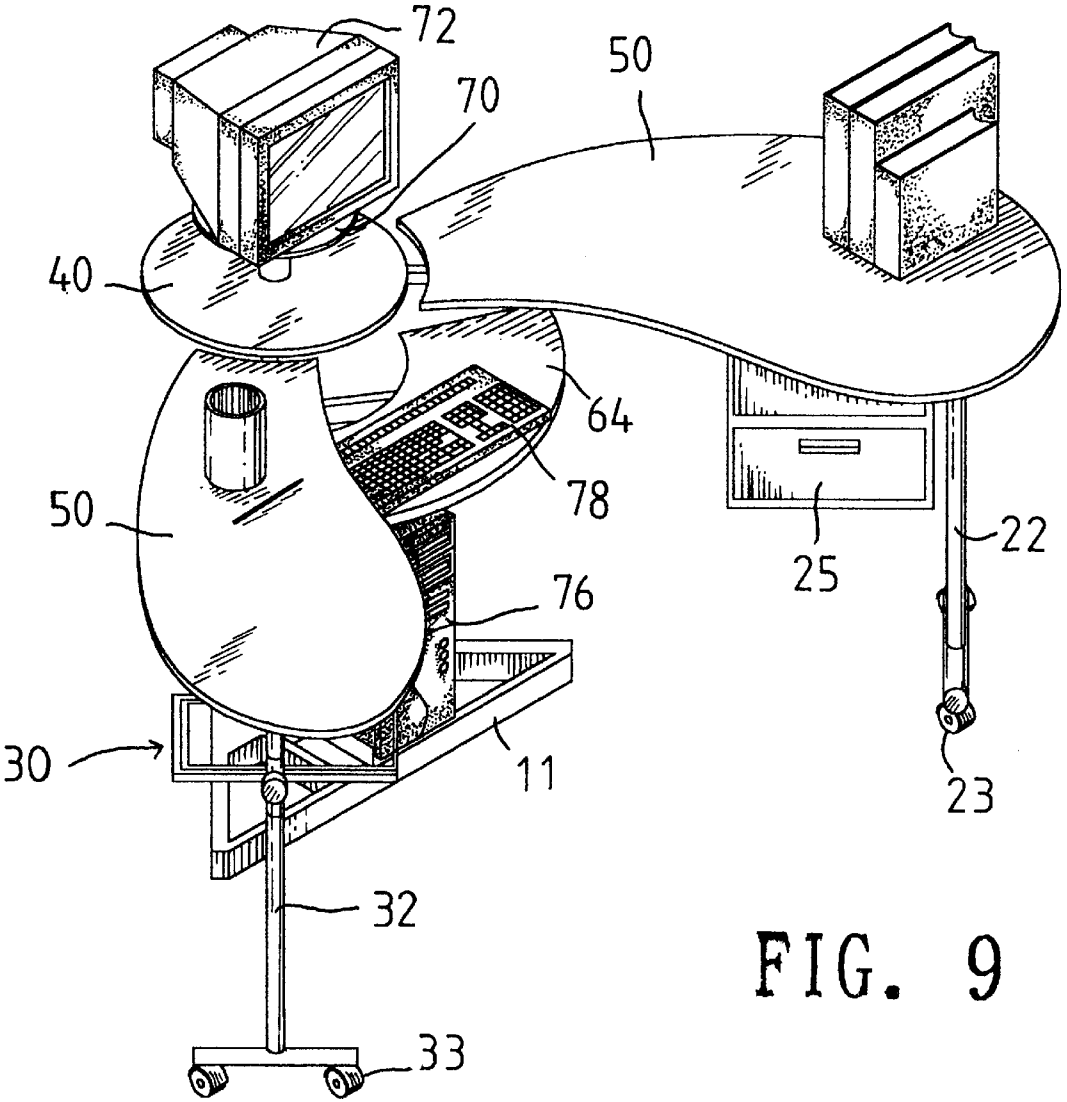
FIG. 9 is a practice view of the computer office table structure as shown in FIG. 6.

As shown in FIGS. 5 and 9, the receiving portion 111 of the supporting base 11 can be used to receive the main body 76 of a computer therein, the keyboard supporting seat 64 can be used to support the keyboard 78 of the computer thereon, and the second supporting disk 70 can be used to support the monitor 72 of the computer thereon. Therefore, the computer office table structure of the present invention can be used to function as an office table or a computer table. In addition, the first keyboard supporting bar 61 and the second keyboard supporting bar 60 can be pivoted relative to the supporting post 14 such that the keyboard supporting seat 64 can be moved, thereby optionally adjusting the position of the keyboard 78 so as to satisfy the requirement of the user.

Although the present invention has been described with a certain degree of particularity, it is to be understood that the present disclose has been made by way of example only and that many other possible modifications and variations can be made without departing from the scope of the present invention.

I claim:

1. A computer office table structure comprising:

a supporting base;

an upstanding rod having a lower end fixed to the supporting base and an upper end provided with a shoulder, a supporting post extending upward from the shoulder and having a diameter smaller than that of the upstanding rod;

a first table supporting member pivotally mounted to the upstanding rod and provided with a plurality of crossbars, the first table supporting member including a first end provided with a first extension bar having a first sleeve rotatably mounted on the supporting post, and a second end provided with a first table leg and two first rollers each rotatably mounted on the first table leg;

a second table supporting member pivotally mounted to the upstanding rod and provided with a plurality of crossbars, the second table supporting member including a first end provided with a second extension bar having a second sleeve rotatably mounted on the supporting post and a second end provided with a second table leg and two second rollers each rotatably mounted on the second table leg;

two table plates each mounted on the first table supporting member and the second table supporting member; and a supporting disk mounted on the supporting post and having a level flush with that of the two table plates, said supporting disk including an insert tube provided on the bottom thereof and mounted on the supporting post.

2. The computer office table structure as claimed in claim 1, wherein the first extension bar of the first table supporting member is inclined relative to the first table supporting member, and the second extension bar of the second table supporting member is inclined relative to the second table supporting member.

3. The computer office table structure as claimed in claim 2, wherein the inclination of the first extension bar is different from that of the second extension bar such that the first table supporting member has a level flush with that of the second table supporting member.

4. The computer office table structure as claimed in claim 1, wherein the supporting base defines a receiving portion therein.

5. The computer office table structure as claimed in claim 1, further comprising a first keyboard supporting bar having a first end provided with a first bushing rotatably mounted on the supporting post and a second end provided with a first keyboard supporting disk, a second keyboard supporting bar having a first end provided with a second bushing rotatably mounted on the supporting post and a second end provided with a second keyboard supporting disk, and a keyboard supporting seat mounted on the first keyboard supporting disk and the second keyboard supporting disk.

6. A computer office table structure comprising:

a supporting base;

an upstanding rod having a lower end fixed to the supporting base and an upper end provided with a shoulder, a supporting post extending upward from the shoulder and having a diameter smaller than that of the upstanding rod;

a first table supporting member pivotally mounted to the upstanding rod and provided with a plurality of crossbars, the first table supporting member including a first end provided with a first extension bar having a first sleeve rotatably mounted on the supporting post, and a second end provided with a first table leg and two first rollers each rotatably mounted on the first table leg;

a second table supporting member pivotally mounted to the upstanding rod and provided with a plurality of crossbars, the second table supporting member including a first end provided with a second extension bar having a second sleeve rotatably mounted on the supporting post and a second end provided with a second table leg and two second rollers each rotatably mounted on the second table leg;

two table plates each mounted on the first table supporting member and the second table supporting member; and a supporting disk mounted on the supporting post and having a level flush with that of the two table plates, the supporting disk defining a hole therein, and the computer office table structure comprising a second supporting disk provided with an insert tube on the bottom thereof and received in the hole of the supporting disk.

7. The computer office table structure as claimed in claim 6, wherein the supporting disk includes an insert tube provided on the bottom thereof and mounted on the supporting post.

8. The computer office table structure as claimed in claim 6, wherein the first extension bar of the first table supporting member is inclined relative to the first table supporting member, and the second extension bar of the second table supporting member is inclined relative to the second table supporting member.

9. The computer office table structure as claimed in claim 8, wherein the inclination of the first extension bar is different from that of the second extension bar such that the first table supporting member has a level flush with that of the second table supporting member.

10. The computer office table structure as claimed in claim 6, wherein the supporting base defines a receiving portion therein.

11. The computer office table structure as claimed in claim 6, further comprising a first keyboard supporting bar having a first end provided with a first bushing rotatably mounted on the supporting post and a second end provided with a first keyboard supporting disk, a second keyboard supporting bar having a first end provided with a second bushing rotatably mounted on the supporting post and a second end provided with a second keyboard supporting disk, and a keyboard supporting seat mounted on the first keyboard supporting disk and the second keyboard supporting disk.

* * * * *